United States Patent [19]

King et al.

[11] Patent Number: 4,628,858

[45] Date of Patent: Dec. 16, 1986

[54] WHEEL MASK

[76] Inventors: Michael L. King, P.O. Box 2051, Greenfield, Calif. 93927; Paul A. King, 51201 Pine Canyon Rd. #21, King City, Calif. 93930

[21] Appl. No.: 710,087

[22] Filed: Apr. 22, 1985

[51] Int. Cl.[4] ..... B05C 21/00

[52] U.S. Cl. ..... 118/504; 118/505

[58] Field of Search ..... 118/504, 505; 15/246, 15/248 R; 51/310, 311, 312, 261.1, 265, 274

[56] References Cited

U.S. PATENT DOCUMENTS

| | | | |
|---|---|---|---|
| 1,126,314 | 1/1915 | Swanton | 118/505 X |
| 1,507,774 | 9/1924 | Hill | 118/504 |
| 2,081,666 | 5/1937 | Gunn | 118/505 |
| 2,800,874 | 7/1957 | Leslie | 118/504 X |
| 2,835,222 | 5/1958 | Hall | 118/505 |
| 3,001,509 | 9/1961 | Carpenter et al. | 118/505 |
| 3,007,401 | 11/1961 | Kordenbrock | 118/505 X |
| 4,217,854 | 8/1980 | Brown | 51/274 X |
| 4,248,914 | 2/1981 | McClane | 427/282 |

*Primary Examiner*—John P. McIntosh

[57] ABSTRACT

A generally semi-circular or "U"-shaped plastic shield of a width to cover a sidewall of a tire, and having a radially outwardly extending handle midway between its opposite end, so as to flex the shield and fit its inner edge between a wheel rim and the tire.

1 Claim, 3 Drawing Figures

WHEEL MASK

BACKGROUND OF THE INVENTION

This invention relates generally to masking devices. More specifically, it relates to a masking shield for covering objects adjacent an area being sprayed. Still more specifically, it relates to a shield that protects a sidewall of an automotive tire from flying spray, while a side face of a wheel is being refinished by a spray gun or the like.

Heretofore, when an automobile body or when only the wheels are being refinished by spraying, such as in a commercial car repainting shop, the tire side walls are always masked over, so as to prevent paint getting sprayed on the tire that is mounted on the wheel, and the need to then clean up the tire sidewall afterwards, or else it eliminates the time-consuming chore of first dismounting all of the tires from the wheel rims and then re-mounting them again afterwards. Tire shields for such purpose have, accordingly, been developed in the past, such as, for example, in the U.S. Pat. No. 2,835,222 to Hall, U.S. Pat. No. 3,007,401 to Kordenbrock, and U.S. Pat. No. 2,081,666 to Gunn. However, in a shop that services many automobiles having wheels of all sizes, such shields have the disadvantage of not being suitable to fit all these sizes, so that numerous sides of wheel templates or stencils must be stored on hand for interchangeable use. This situation is, accordingly, in need of an improvement.

SUMMARY OF THE INVENTION

Therefore, it is a principal object of the present invention to provide a wheel shield which is readily adjustable in size, so as to fit all different sizes of wheels.

Another object is to provide a wheel shield which is quickly and easily adjustable by simply moving a handle, requiring only an instant moment.

Another object is to provide a wheel shield that is inexpensive and requires no skill to use.

Yet another object is to provide a wheel shield which makes wheel refinishing easier by being readily slipped between the wheel rim and tire for fast attachment.

These, and other objects, will be readily evident upon a study of the following Specification and the accompanying Drawing.

BRIEF DESCRIPTION OF THE DRAWING FIGURES

DETAILED DESCRIPTION OF PREFERRED EMBODIMENT

Figure 1:
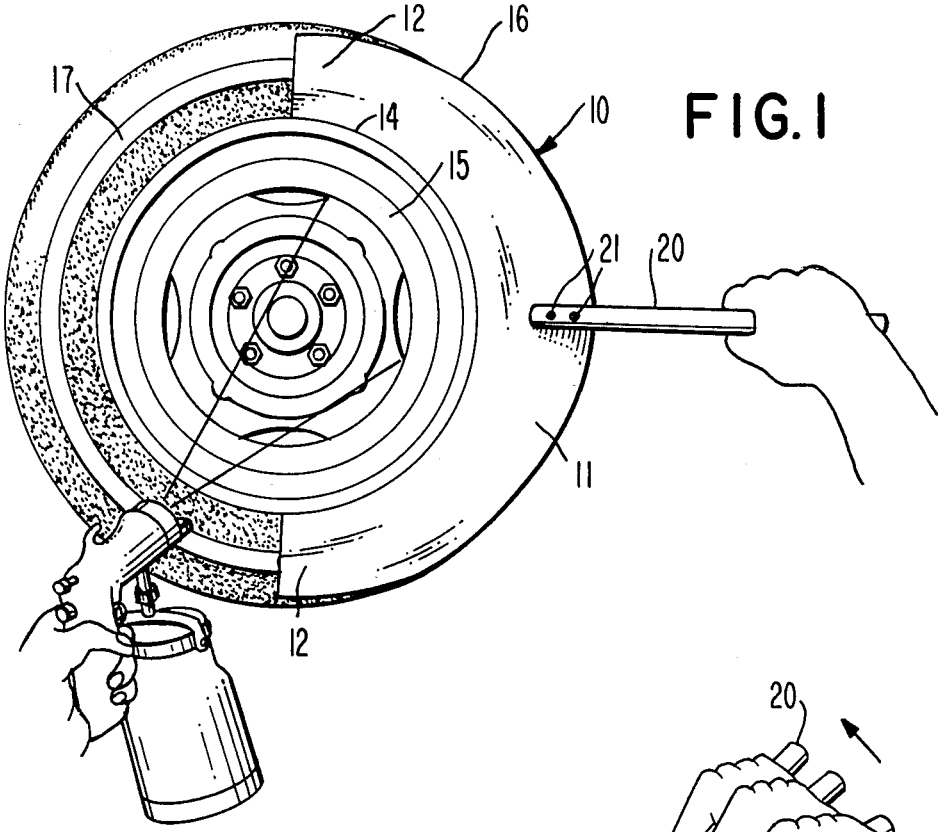
FIG. 1 is a side elevational view of the present invention, shown in operative use, masking a tire while the side face of the wheel is being refinished.
Figure 2:
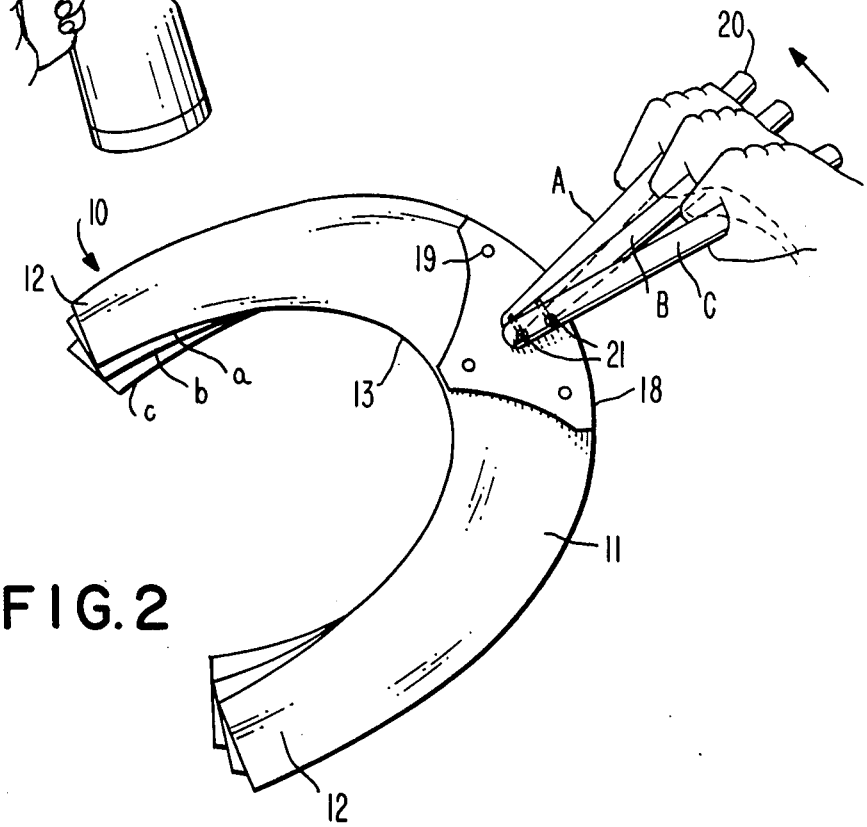
FIG. 2 is a side perspective view of the wheel stencil, shown per se, and illustrating how tilting a handle thereof forwardly different distances, changes the stencil contour correspondingly.
Figure 3:
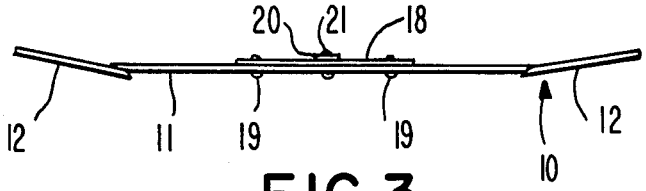
FIG. 3 is an edge view thereof, and showing it slightly angled at its ends so as to fit snugly between an automotive wheel and a tire.

Referring now to the Drawing in greater detail, the reference numeral 10 represents a wheel shield, according to the present invention, wherein there is a "U"-shaped template body 11 made of a semi-rigid plastic material, so as to be flexible, as needed, when in use. As shown in the Drawing, it is made approximately semi-circular in length, and as indicated in FIGS. 2 and 3, may be slightly inwardly dished or have opposite ends 12 that are slightly angled, so that an edge 13 thereof may readily slip between a rim 14 of a wheel 15 and a tire 16. The body is made wide enough so as to shield the full width of the tire sidewall 17.

A triangular plate 18, for purposes of rigidity, is affixed by means of rivets 19 or the like, to an outer side of a longitudinally center portion of the body, so as to form a mount to which a rigid handle 20 is attached by rivets 21; the handle being elongated and extending in a radially outwardly direction respective to the body.

In use, in order to fit the body to any specific size of domestic or foreign car wheel, the handle is simply moved transversely to the general plane of the body, so as to cause the body ends to be moved closer toward each other and thus, change the circular arc of the edge 13 in order to fit the particular size of wheel rim. Thus, as shown in FIG. 2, when the handle is moved between positions A, B and C, the ends and edge correspondingly change to positions a, b and c.

While various changes may be made in the detail construction, it is understood that such changes will be within the spirit and scope of the present invention, as is defined by the appended claim.

What we claim as new is:

1. A masking device for a tire mounted on a wheel rim, comprising, in combination:

a flexible, "U"-shaped member having two ends;

a substantially triangular shaped handle mounting member attached to said "U"-shaped member equidistant from said ends, and a handle attached to said handle mounting member, whereby when said handle is raised, the ends of the "U"-shaped member are deflected inward to fit said rim.

* * * * *